US007175549B2

(12) United States Patent
LeFlore

(10) Patent No.: US 7,175,549 B2
(45) Date of Patent: Feb. 13, 2007

(54) BASKETBALL TRAINING METHOD TO IMPROVE JUMP SHOOTING

(76) Inventor: Rudolphus LeFlore, 8013 Ocean View Ave., Whittier, CA (US) 90602

( * ) Notice: Subject to any disclaimer, the term of this patent is extended or adjusted under 35 U.S.C. 154(b) by 0 days.

(21) Appl. No.: 11/292,921

(22) Filed: Dec. 2, 2005

(65) Prior Publication Data

US 2006/0105863 A1 May 18, 2006

Related U.S. Application Data

(62) Division of application No. 10/780,664, filed on Feb. 19, 2004, now abandoned.

(60) Provisional application No. 60/485,989, filed on Jul. 11, 2003.

(51) Int. Cl.
*A63B 69/00* (2006.01)

(52) U.S. Cl. ..... 473/448; 473/447

(58) Field of Classification Search ..... 473/447, 473/448

See application file for complete search history.

(56) References Cited

U.S. PATENT DOCUMENTS

| | | | | |
|---|---|---|---|---|
| 4,326,717 | A | 4/1982 | McClimon | |
| 4,497,485 | A | 2/1985 | Macosko | |
| 4,538,808 | A | 9/1985 | Holland | |
| 4,629,188 | A | 12/1986 | Mahieu | |
| 4,718,668 | A | 1/1988 | Schipske | |
| 4,796,886 | A | 1/1989 | Loh et al. | |
| 4,905,996 | A | 3/1990 | Tallent et al. | |
| 5,029,853 | A | 7/1991 | Cunningham | |
| 5,324,026 | A | 6/1994 | Conlon et al. | |
| 5,485,993 | A | 1/1996 | Lipsett | |
| 5,599,016 | A | 2/1997 | Larkin | |
| 5,642,879 | A | 7/1997 | Rodriguez | |
| 5,800,291 | A * | 9/1998 | Grover | 473/447 |
| 5,875,597 | A | 3/1999 | Gingrich et al. | |
| 6,159,111 | A | 12/2000 | Purcell | |
| 6,161,320 | A | 12/2000 | Peterson | |
| 6,213,899 | B1 | 4/2001 | Maske | |
| 6,544,132 | B1 | 4/2003 | Tvedt | |
| 2004/0157685 | A1 * | 8/2004 | Hodges | 473/448 |

* cited by examiner

*Primary Examiner*—Eugene Kim
*Assistant Examiner*—M. Chambers
(74) *Attorney, Agent, or Firm*—Kenneth L. Green; Edgar W. Averill, Jr.

(57) ABSTRACT

A basketball training aid and method requires a player to jump to sufficient height to see a basket over a curtain, and to shoot over the curtain. The training aid comprises an easily adjustable stand for positioning the curtain. The curtain blocks the player's view of the basket. The aid is adjusted to an individual player to challenge the player to achieve a minimum height to see the basket and to shoot over the aid. The player must coordinate jumping, seeing the basket, and releasing the ball at the apex of the jump. As a result, muscle memory is developed thereby improving player performance.

15 Claims, 6 Drawing Sheets

BASKETBALL TRAINING METHOD TO IMPROVE JUMP SHOOTING

The present application is a divisional of co-pending U.S. patent application Ser. No. 10/780,664 filed Feb. 19, 2004 now abandoned and claims the benefit of U.S. Provisional Application Ser. No. 60/485,989, filed Jul. 11, 2003. The '664 utility application and the '989 provisional application are incorporated herein by reference.

BACKGROUND OF THE INVENTION

The present invention relates to sports training aids, and in particular to an aid for improving basketball jump shots.

Proficiency in the sport of basketball requires developing the ability to shoot over opposing players, and the ability to achieve height significantly enhances a player's likelihood of successfully shooting over an opponent. Various training aids have been proposed to assist in developing these abilities.

U.S. Pat. No. 4,538,808 issued Sep. 3, 1985 for "Device for Training Basketball Players to Shoot," describes a frame with intruding members intended to duplicate the experience of shooting in the presence of opponents, but fails to force the player to jump and release the ball at a minimum height. U.S. Pat. No. 5,599,016 issued Feb. 4, 1997 for "Muscle-Memory Method and Basketball Training Aid," describes a frame supporting an elevated horizontal window for a player to reach through to shoot. U.S. Pat. No. 5,642,879 issued Jul. 1, 1997 for "Sports Practice Apparatus," describes a vertically positionable net for use in practice. U.S. Pat. No. 6,544,132 issued Apr. 8, 2003 for "Basketball Practice System," describes an adjustable window for a player to shoot through to develop a desired arc in ball's trajectory.

Although various attempts have been made to provide an apparatus and method for training basketball players, none require the player to jump to both see and shoot at the basket.

BRIEF SUMMARY OF THE INVENTION

The present invention addresses the above and other needs by providing a basketball training aid and method requiring a player to jump to sufficient height to see a basket over a curtain, and to shoot over the curtain. The training aid comprises an easily adjustable stand for positioning the curtain. The curtain blocks the player's view of the basket. The aid is adjusted to an individual player to challenge the player to achieve a minimum height to see the basket and to shoot over the aid. The player must coordinate jumping, seeing the basket, and releasing the ball at the apex of the jump. As a result, muscle memory is developed thereby improving player performance.

In accordance with one aspect of the invention, there is provided a basketball training aid comprising vertical supports having support tops and support bottoms, bases attached to the support bottoms for holding the vertical supports approximately vertical, and an upper portion slidably engagable with the vertical supports. The upper portion is vertically fixable using a pair of outwardly biased positioning pins residing partially within the upper portion, in cooperation with a corresponding pair of a multiplicity of vertically spaced apart positioning holes relative to said vertical supports. A vertically disposed substantially opaque curtain is attached to an upper bar of the upper portion. The curtain includes grommets proximal to bottom corners of the curtain, and a pair of tensioners are attached between the grommets and a corresponding pair of a mutliplicity of vertically spaced apart tensioner holes defined in the vertical supports.

BRIEF DESCRIPTION OF THE SEVERAL VIEWS OF THE DRAWING

The above and other aspects, features and advantages of the present invention will be more apparent from the following more particular description thereof, presented in conjunction with the following drawings wherein.

Corresponding reference characters indicate corresponding components throughout the several views of the drawings.

DETAILED DESCRIPTION OF THE INVENTION

The following description describes the best mode presently contemplated for carrying out the invention. This description is not to be taken in a limiting sense, but is made merely for the purpose of describing one or more preferred embodiments of the invention. The scope of the invention should be determined with reference to the claims.

Figure 1:
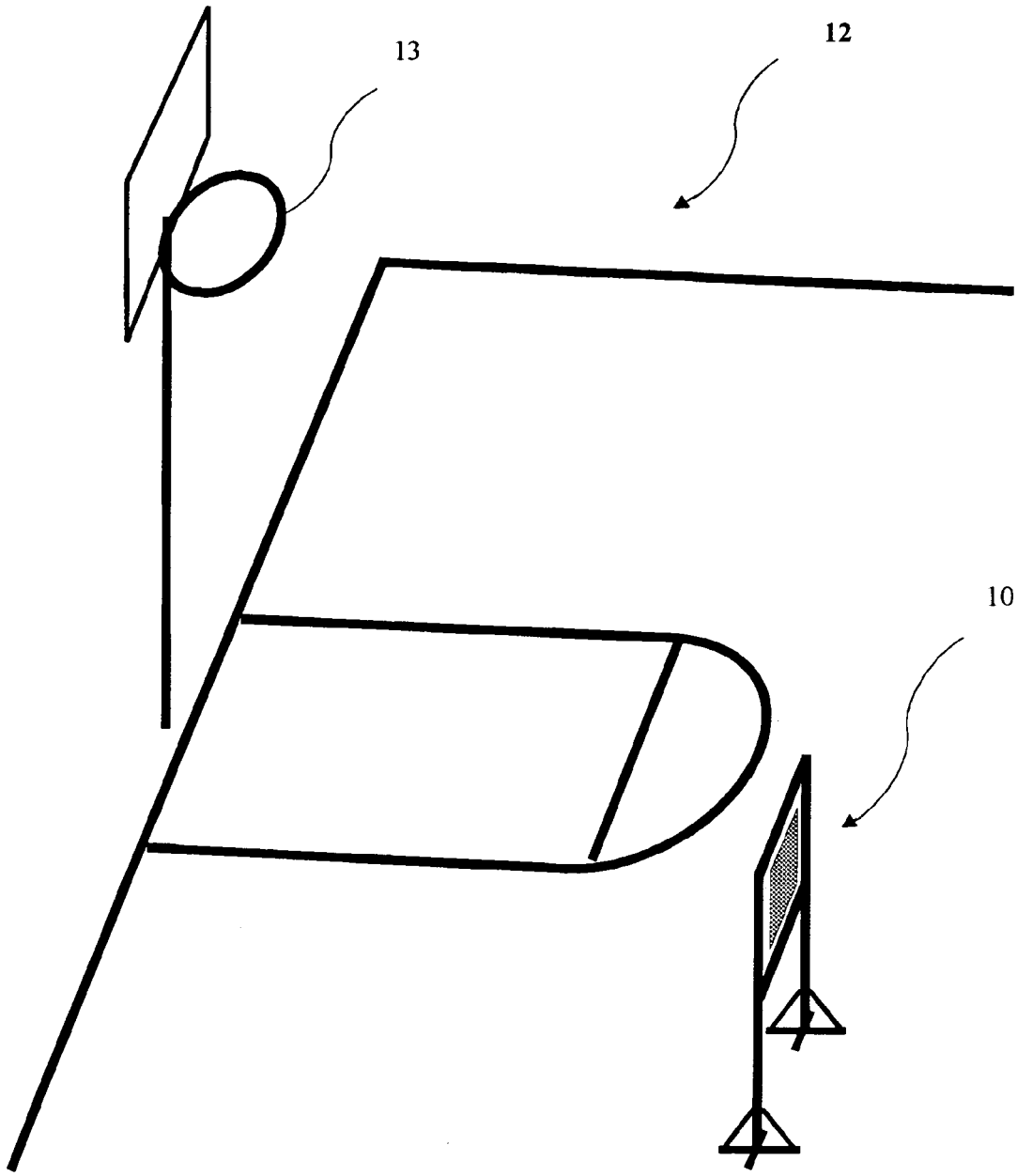
FIG. 1 is a view of a training aid positioned on a basketball court.

A training aid 10 according to the present invention is shown positioned on a basketball court 12 in FIG. 1. The training aid 10 may be positioned at any appropriate location on the court 12. The training aid 10 includes an opaque curtain 25 (see FIG. 2) which both blocks a players vision and shot at the basket 13, thus forcing the player both jump to see the basket 13, and to shoot, thereby developing muscle memory.

Figure 2:
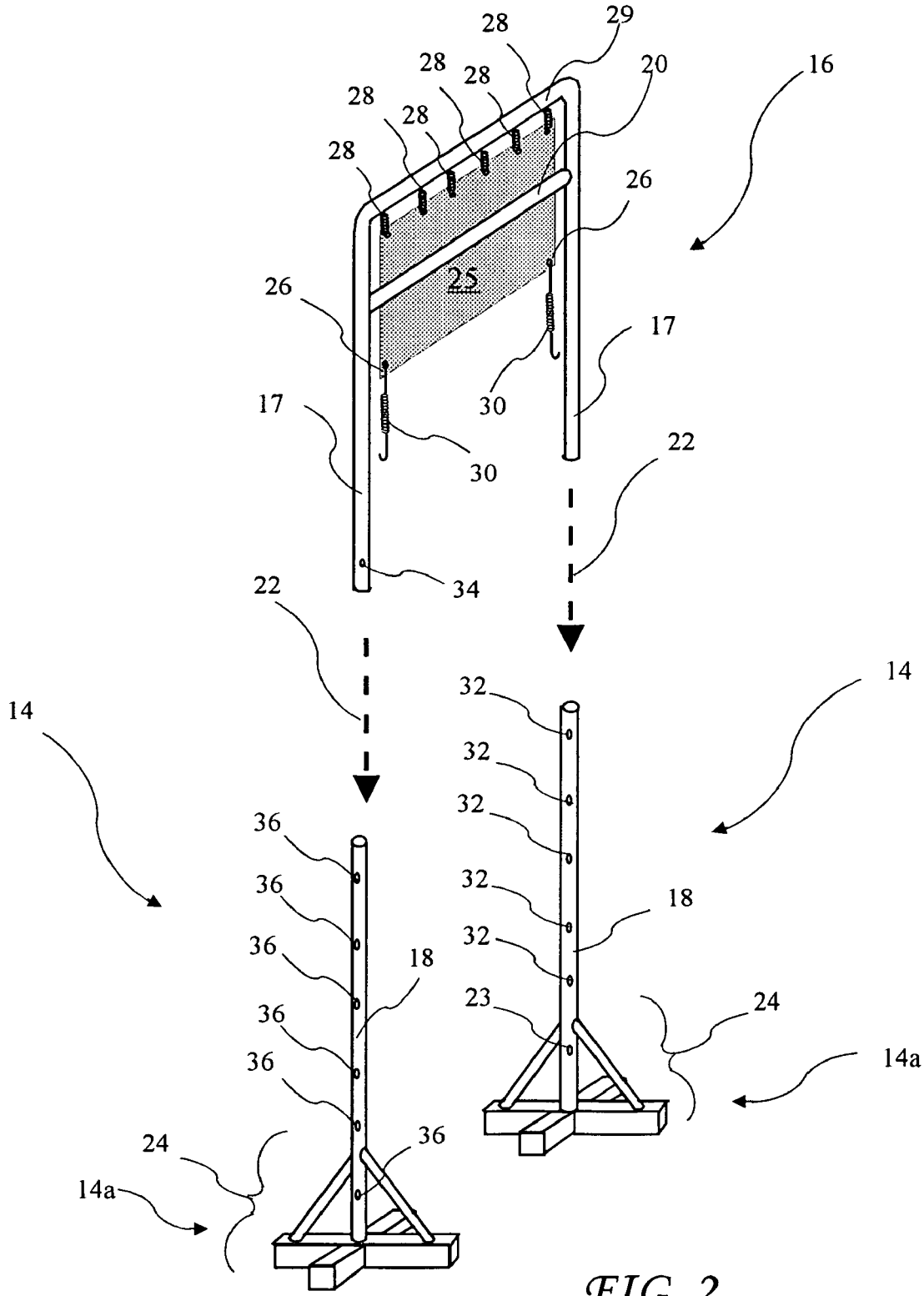
FIG. 2 is a view of the training aid with an upper portion detached from vertical support members.

The shooting aid 10 comprises vertical supports 14 and an upper portion 16 as shown in FIG. 2. A substantially opaque curtain 25 is attached to an upper bar 29 of the upper portion 16 by hangers 28, which hangers 28 are preferably hooks or springs, and more preferably hooks. The curtain 25 has bottom corners 26, and tensioners 30 are attached to the bottom corners 26 of the curtain 25. A first positioning hole 34 is defined in upper vertical members 17 of the upper portion 25. A horizontal brace 20 connects upper vertical members 17 to add strength to the upper portion 16. The vertical supports 14 include bases 24 residing at support bottoms 14*a*. A multiplicity of vertically spaced apart tensioning holes 32, and a multiplicity of vertically spaced apart second position holes 36, are defined on lower vertical supports 18.

Figure 3A:
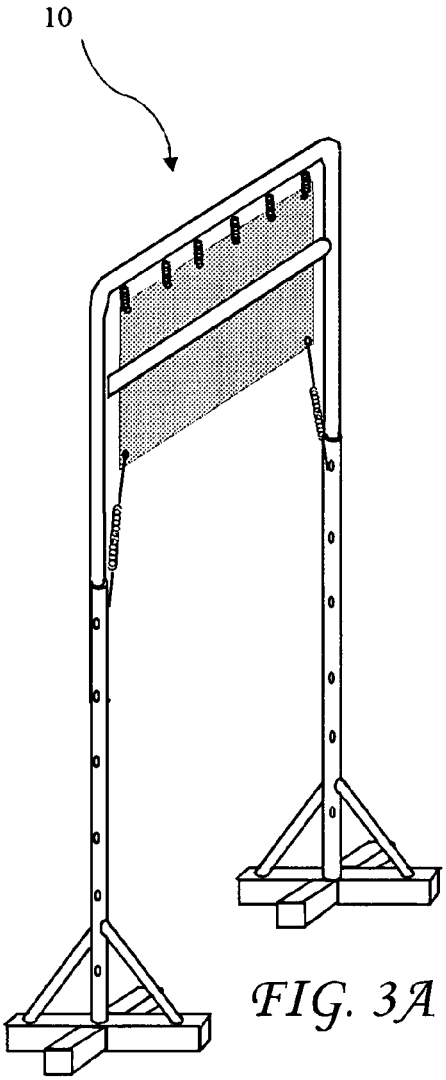
FIG. 3A shows the training aid in a high position.
Figure 3B:
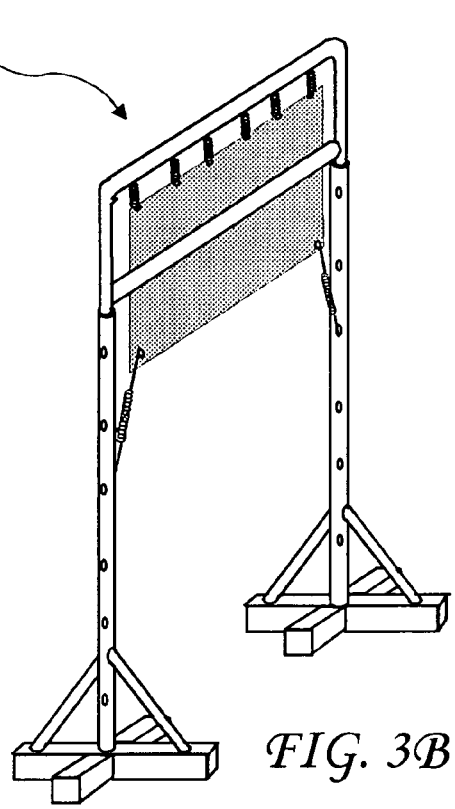
FIG. 3B shows the training aid in a low position.

The training aid 10 is vertically adjustable. A view of the training aid 10 in a high position is shown in FIG. 3A, and in a low position is shown in FIG. 3B.

Figure 4A:
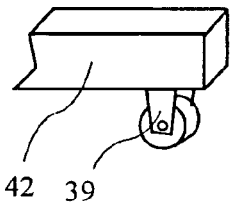
FIG. 4A depicts a base having casters.
Figure 4:
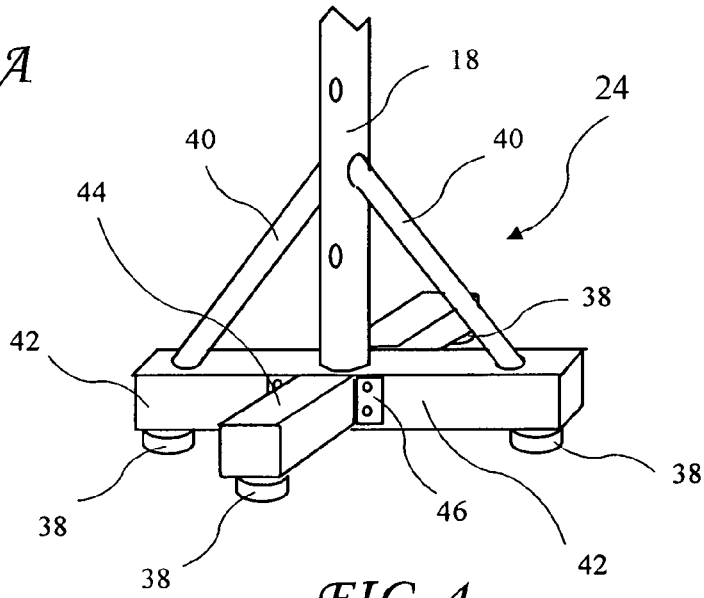
FIG. 4 is a detailed view of a base suitable for use with the training aid.

The base 24 is shown in detail in FIG. 4. The base 24 includes a forward brace member 42 and a lateral brace member 44. The forward brace member 42 is approximately twenty inches in total length, and the lateral brace member 44 is approximately twelve inches in total length. Adjustable feet 38 are attached near the end of each brace member 42, 44, and a diagonal brace 40 is attached between the ends of the forward brace 42 and the lower vertical members 18. A bracket 46 may be used to attached the lateral brace members 44 to the forward brace members 42. A preferred base shown partially in FIG. 4A includes casters 39 replacing feet 38 moutned to the brace members 42,44.

Figure 5A:
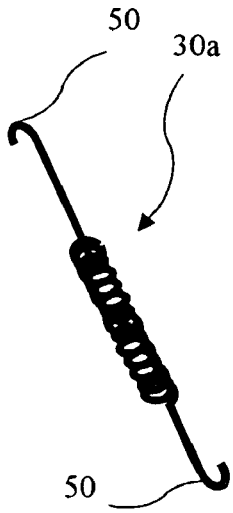
FIG. 5A is a detailed view of a tensioner comprising a spring tensioner.
Figure 5B:
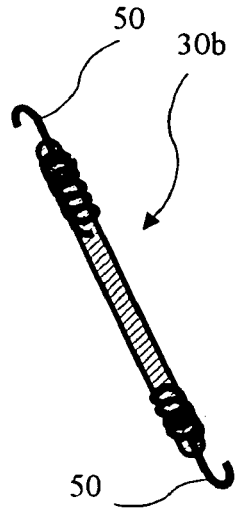
FIG. 5B is a detailed view of a tensioner comprising a bungi tensioner.
Figure 6A:
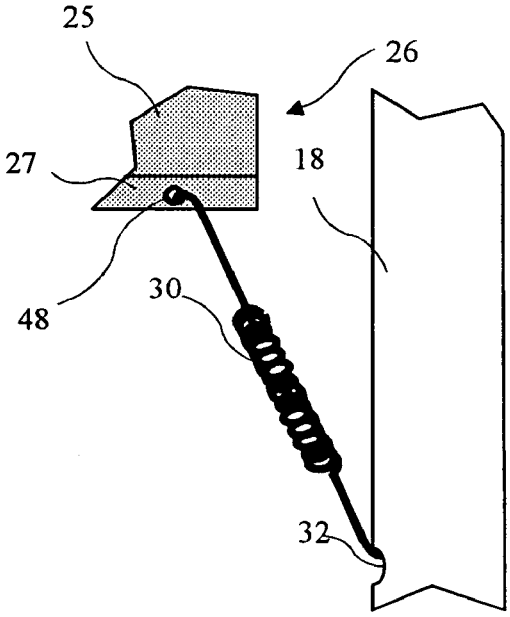
FIG. 6A is a first embodiment of the tensioner for holding a curtain in place on the training aid.
Figure 6B:
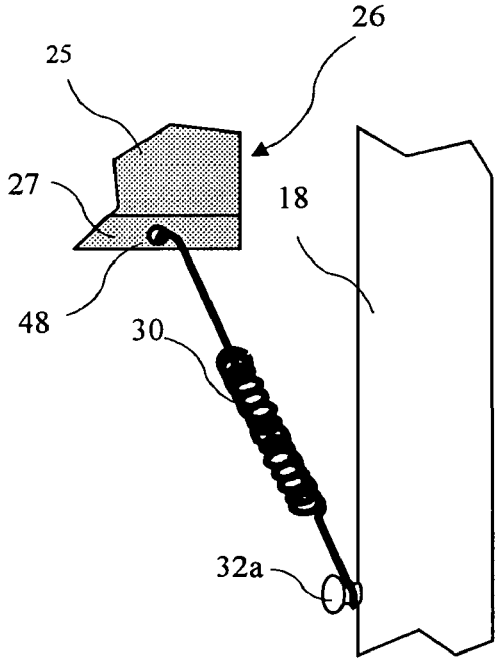
FIG. 6B is a second embodiment of the tensioner for holding the curtain in place on the training aid.

A detailed views of two embodiments of the tensioner 30 are shown in FIGS. 5A and 5B, wherein the first tensioner 30*a* is a spring tensioner having hooked ends 50, and the second tensioner 30*b* is a bunji tensioner also having hooked ends 50. Detailed views of the tensioner 30 in use are shown in FIGS. 6A and 6B. The tensioner 30 is connected to the curtain 25 at a grommet 48 in a bottom corner 26. The grommet 48 is in a reinforced curtain edge 27 running along the bottom of the curtain 25. The tensioner 30 may be connected by inserting one of the hooked ends 50 into a tensioner hole 32 in the lower vertical member 18 (FIG. 6A), or by hooking one of the hooked ends 50 around a tensioner post 32*a* attached to the lower support member 18.

Figure 7:
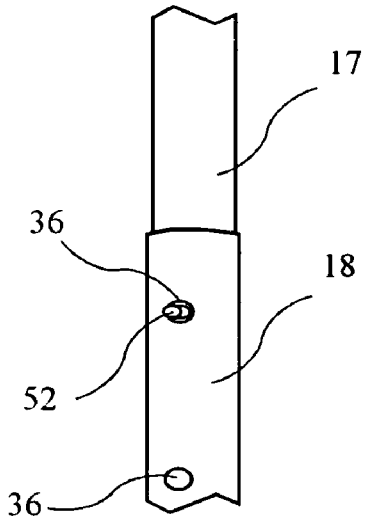
FIG. 7 shows a positioning pin used to fix the vertical position of the upper portion relative to the vertical supports.
Figure 8:
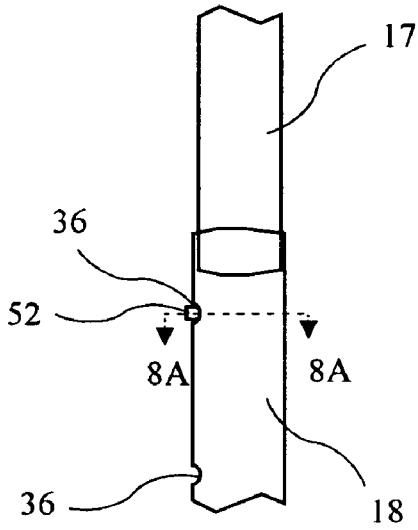
FIG. 8 is a side view of the positioning pin used to fix the vertical position of the upper portion relative to the vertical supports.

Views of the cooperation of a positioning pin 52 with one of the lower vertical members 18 to fix the vertical position of the upper portion 16 (see FIG. 2) relative to the vertical supports 14 (see FIG. 2) are shown in FIGS. 7 and 8. The pair of positioning pins 52 may cooperate with one corresponding pair of the multiplicity of vertically spaced apart positioning holes 36 in the lower vertical member 18 to determine the height of the curtain 25 (see FIGS. 3A and 3B).

Figure 8A:
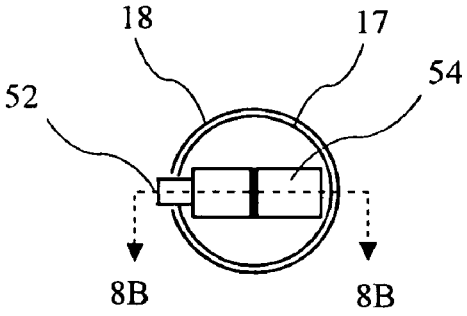
FIG. 8A is a cross-sectional view of the positioning pin in cooperation with the upper portion and one of the vertical supports, taken along line 8A—8A of FIG. 8.
Figure 8B:
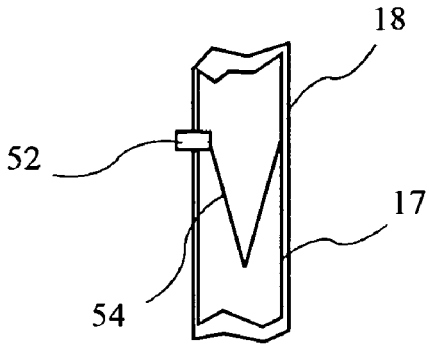
FIG. 8B is a cross-sectional view of the positioning pin outwardly biased by a leaf spring, the positioning pin in cooperation with the upper portion and one of the vertical supports, taken along line 8B—8B of FIG. 8A.
Figure 9:
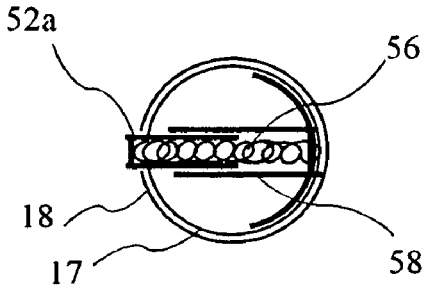
FIG. 9 is a cross-sectional view of the positioning pin outwardly biased by a coil spring, the positioning pin in cooperation with the upper portion and one of the vertical supports, taken along line 8A—8A of FIG. 8.

A cross-sectional view of the cooperation of the positioning pin 52 with the upper vertical member 17 and lower vertical member 18 taken along line 8A—8A of FIG. 8 is shown in FIG. 8A. A leaf spring 54 biases the positioning pin 52 outwardly. A second cross-sectional view of the cooperation of the positioning pin 52 with the upper vertical member 17 and lower vertical member 18 taken along line 8B—8B of FIG. 8 is shown in FIG. 8B, wherein the leaf spring 54 is shown to have a "V" shape. An alternative embodiment including a coil spring 56 with a spring positioner 58 to outwardly bias the positioning pin 52 is shown in FIG. 9.

Figure 10:
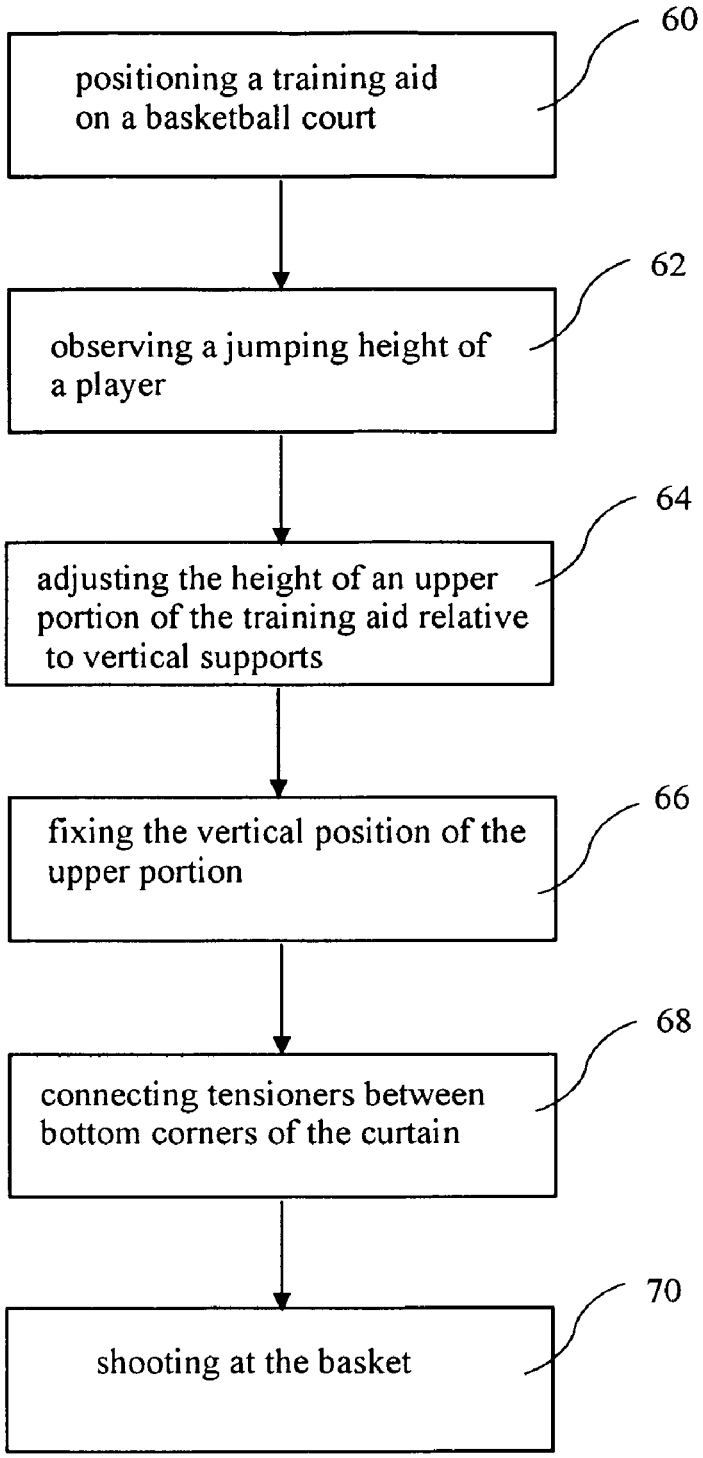
FIG. 10 depicts a method for training basketball players according to the present invention.

A method for training a player using the training aid 10 is shown in FIG. 10. The method comprises positioning a training aid on a basketball court, wherein the training aid is positioned between a shooting position and a basket at step 60, observing a jumping height of a player at step 62, adjusting the height of an upper portion of the training aid relative to vertical supports based on the observed jumping height, wherein a vertically disposed substantially opaque curtain is attached to the upper portion at step 64, fixing the vertical position of the upper portion relative to the vertical supports at step 66, connecting tensioners between bottom corners of the curtain to attachment points on the vertical supports at step 68, and shooting at the basket, wherein the player must jump to coordinatedly see over the training aid and to shoot over the training aid at step 70.

While the invention herein disclosed has been described by means of specific embodiments and applications thereof, numerous modifications and variations could be made thereto by those skilled in the art without departing from the scope of the invention set forth in the claims.

I claim:

1. A method for improving athletic skills, the method comprising:

positioning a training aid on an athletic playing area, wherein the training aid is positioned between an athlete position and a distal portion of the playing area, the training aid including an opaque portion;

aligning the training aid to position the opaque portion to completely block a view of the distal portion by an athlete standing at the athlete position, wherein the player must jump to view the distal portion; and practicing a play, wherein the athlete must coordinatedly jump to see over the opaque portion and execute an aspect of the play over the opaque portion, and wherein positioning the training aid on the athletic playing area comprises positioning the training aid on a basketball court and wherein the positioning a training aid comprises positioning an adjustable height training aid, and observing the height of an athlete standing at the athlete position with respect to the opaque portion; and adjusting the height of the opaque portion so that the standing athlete cannot see over the opaque portion and the athlete may jump to see over the opaque portion.

2. The method of claim 1, wherein the positioning a training aid on the basketball court comprises positioning the training aid on the basketball court, wherein the training aid is positioned between the athlete position and a basket.

3. The method of claim 2, wherein the positioning the training aid comprises positioning the training aid so that the opaque portion blocks the athlete's view of the basket.

4. The method of claim 3, wherein practicing a play comprises practicing coincidentally jumping to see over the opaque portion and shooting a basket over the opaque portion.

5. The method of claim 1, wherein the adjusting the height of the opaque portion comprises adjusting the height of the training aid, wherein the height of the opaque portion is approximately the height of the training aid.

6. A method for improving athletic skills, the method comprising:

positioning an adjustable height training aid on an athletic playing area, wherein the training aid is positioned between an athlete position and a distal portion of the playing area, wherein the adjustable height training aid includes an opaque portion;

observing the height of an athlete standing at the athlete position, with respect to the opaque portion; and adjusting the height of the opaque portion based on the observed height so that the athlete must jump to see the distal portion over the opaque portion and the athlete can see the distal portion over the opaque portion when the athlete jumps; and practicing a play, wherein the athlete must coordinatedly jump to see over the opaque portion and execute an aspect of the play over the opaque portion, and wherein positioning the training aid on the athletic playing area comprises positioning the training aid on a basketball court and wherein the positioning the adjustable height training aid on the athletic playing area comprises positioning the adjustable height training aid on a basketball court wherein the positioning a training aid comprises positioning an adjustable height training aid, and observing the height of an athlete standing at the athlete position with respect to the opaque portion; and adjusting the height of the opaque portion so that the standing athlete cannot see over the opaque portion and the athlete may jump to see over the opaque portion.

7. The method of claim 6, wherein the positioning the adjustable height training aid on the basketball court comprises positioning the adjustable height training aid on the basketball court, wherein the adjustable height training aid is positioned between the athlete position and a basket.

8. The method of claim 7, wherein practicing a play comprises practicing coincidentally jumping to enable:

seeing over the opaque portion; and shooting a basket over the opaque portion.

9. The method of claim 8, wherein jumping comprises jumping at least a minimum height to see the basket.

10. The method of claim 8, wherein jumping to shoot a basket comprises jumping to shoot at the apex of the jump.

11. A method for improving a basketball player's shooting performance, the method comprising:

positioning an adjustable height training aid on a basketball court wherein the training aid is positioned between a shooting position and a basket;

observing a jumping height of an athlete standing at the shooting position;

adjusting a height of an upper opaque portion of the training aid based on the observed jumping height so that the athlete must jump to see a distal portion over the opaque portion of the training aid and the athlete can see the distal portion over the opaque portion when the athlete jumps; and shooting at the basket, wherein the player must jump to coordinatedly see over the training aid and to shoot over the training aid.

12. The method of claim 11, wherein after the adjusting the height of an upper portion, further including fixing the vertical position of the upper portion relative to vertical supports.

13. The method of claim 12 wherein fixing the vertical position of the upper portion relative to vertical supports comprises engaging positioning pins in corresponding ones of a multiplicity of vertically spaced apart position holes.

14. The method of claim 11 wherein after the adjusting the height of an upper portion, further including connecting tensioners between bottom corners of a curtain to attachment points on the vertical supports.

15. The method of claim 11 wherein the adjusting the height of an upper portion comprises adjusting the height of an upper portion including a vertically disposed substantially opaque curtain.

* * * * *